US008794730B2

(12) United States Patent
Yamamoto

(10) Patent No.: US 8,794,730 B2
(45) Date of Patent: Aug. 5, 2014

(54) IMAGE RECORDING APPARATUS

(75) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 520 days.

(21) Appl. No.: 13/042,967

(22) Filed: Mar. 8, 2011

(65) Prior Publication Data

US 2011/0242180 A1 Oct. 6, 2011

(30) Foreign Application Priority Data

Mar. 31, 2010 (JP) ..... 2010-080772

(51) Int. Cl.
*B41J 29/38* (2006.01)
*B41J 13/00* (2006.01)
*B41J 3/54* (2006.01)

(52) U.S. Cl.
CPC ..... *B41J 13/0009* (2013.01); *B41J 13/009* (2013.01); *B41J 3/543* (2013.01)
USPC ..... 347/16; 347/104

(58) Field of Classification Search
CPC ..... B41J 13/0009
USPC ..... 347/16
See application file for complete search history.

(56) References Cited

U.S. PATENT DOCUMENTS

| | | | | |
|---|---|---|---|---|
| 4,591,884 | A * | 5/1986 | Miyamoto et al. | 347/153 |
| 7,188,929 | B2 | 3/2007 | Lofthus | |
| 2008/0062215 | A1 * | 3/2008 | Kawabata | 347/16 |
| 2008/0211863 | A1 | 9/2008 | Chikamoto | |
| 2009/0085998 | A1 * | 4/2009 | Kubota et al. | 347/102 |
| 2009/0092404 | A1 * | 4/2009 | Tashiro et al. | 399/38 |
| 2009/0214228 | A1 * | 8/2009 | Ito | 399/21 |

FOREIGN PATENT DOCUMENTS

| | | | |
|---|---|---|---|
| JP | S59-165075 | A | 9/1984 |
| JP | H09-101722 | A | 4/1997 |
| JP | 2004-070152 | A | 3/2004 |
| JP | 2008-213202 | A | 9/2008 |

OTHER PUBLICATIONS

Japan Patent Office, Decision to Grant a Patent for Japanese Patent Application No. 2010-080772 (counterpart to above-captioned patent application), dispatched Dec. 13, 2011.
European Patent Office, extended European Search Report for European Patent Application No. 11001705.0 (counterpart to above-captioned patent application), dated Mar. 26, 2012.

* cited by examiner

*Primary Examiner* — Manish S Shah
*Assistant Examiner* — Jeffrey C Morgan
(74) *Attorney, Agent, or Firm* — Baker Botts L.L.P.

(57) ABSTRACT

An image recording apparatus including: (a) first and second recording heads; (b) a first conveyance path transiting first and second positions that are opposed to the first and second recording heads; (c) a second conveyance path transiting the first position and a third potion that is other than the second position. The first conveyance path includes a first/second-positions communicating path section communicating the first and second positions while the second conveyance path includes a first/third-positions communicating path section communication the first and third positions. One of the first/second-positions communicating path section and the first/third-positions communicating path section is bent larger than the other. A conveyance velocity of a recording medium is reduced while the recording medium is being conveyed along the above-described one of the communicating path sections, in a case where the liquid is kept ejected from the first recording head upon arrival of the recording medium in the one of the communicating path sections.

9 Claims, 7 Drawing Sheets

IMAGE RECORDING APPARATUS

CROSS REFERENCE TO RELATED APPLICATION

This application claims priority from Japanese Patent Application No. 2010-080772 filed on Mar. 31, 2010, the disclosure of which is herein incorporated by reference in its entirety.

BACKGROUND OF THE INVENTION

Field of the Invention

The present invention relates to an image recording apparatus for recording an image onto a recording medium by ejecting liquid onto the recording medium, and more particularly to such an image reading apparatus that is capable of restraining an amount of consumption of the liquid without deteriorating quality of the recorded image.

There is known an inkjet printer having a plurality of inkjet heads and a conveyor belt. The inkjet heads are arranged in a conveyance direction in which a recording medium is to be conveyed, and have respective ejection surfaces through which ink is to be ejected onto the recording medium. The conveyor belt is configured to convey the recording medium, such that the recording medium is opposed to the respective ejection surfaces when the recording medium is positioned in respective positions corresponding to the respective ejection surfaces. The inkjet printer further has a maintenance unit for performing a maintenance operation onto the inkjet heads. The maintenance unit includes a tray configured to receive the ink and a wiper configured to wipe the ejection surfaces. When the maintenance operation is to be performed onto one of the inkjet heads, the inkjet heads are moved in such a direction that causes the ejection surfaces of the inkjet heads to be moved away from the conveyor belt, and then the tray is positioned in a position between the conveyor belt and the ejection surfaces of the respective inkjet heads, so as to be opposed to the ejection surfaces of the respective inkjet heads. In the maintenance operation, the ink is ejected from the inkjet heads into the tray, and then the ejection surfaces are wiped by the wiper whereby the ink adhering to the ejection surfaces is removed by the wiper.

SUMMARY OF THE INVENTION

In the inkjet printer described above, there is a case (such as recording of a monochrome image) where an image is recorded on a recording medium while at least one of the recording heads is not ejecting ink, i.e., while at least one of the recording heads is not participating in the recording. Even in such a case, the recording sheet is caused to pass a position opposed to the at least one of the recording heads that does not participate in the recording, so that foreign substances such as paper dust flutter also around the recording head or heads that do not participate in the recording. Since the foreign substances are likely to adhere to also the recording head or heads not participating in the recording, a maintenance operation has to be performed onto all the inkjet heads, thereby causing a problem that it is not possible to save an amount of ink that is be consumed in the maintenance operation.

The above problem might be solved by an image recording apparatus having first and second recording heads and first and second conveyance paths. In this image recording apparatus, each of the first and second recording heads has an ejection surface through which liquid is to be ejected. The first conveyance path is a conveyance path along which a recording medium is to be conveyed via first and second positions, such that the recording medium is opposed to the ejection surface of the first recording head when the recording medium is being positioned in the first position, and such that the recording medium is opposed to the ejection surface of the second recording head when the recording medium is being positioned in the second position. Meanwhile, the second conveyance path is another conveyance path along which the recording medium is to be conveyed via the first position and a third position and without via the second position, such that the recording medium is opposed to the ejection surface of the first recording head when the recording medium is being positioned in the first position, and such that the recording medium is not opposed to the ejection surface of the second recording head when the recording medium is being positioned in the third position. In this image recording apparatus, when being conveyed along the second conveyance path, the recording medium does not pass the second position so that there is no risk that foreign substances adhere onto the ejection surface of the second recording head that does not eject the liquid and does not participate in the recording. Therefore, as long as the recording medium is conveyed along the second conveyance path, there is no need to perform a maintenance operation onto the second recording head, thereby making it possible to reduce the amount of consumption of the liquid by the second recording head.

However, this image recording apparatus suffers from a problem due to an arrangement in which the second position and the third position are provided by respective positions different from each other so that a first/second-positions communicating path section of the first conveyance path or a first/third-positions communicating path section of the second conveyance path has to be curved or bent. For example, where one of the first/second-positions communicating path section between the first and second positions and the first/third-positions communicating path section between the first and third positions is constituted by a straight path section, the other of the first/second-positions communicating path section and the first/third-positions communicating path section has to be constituted by a curved or bent path section. Consequently, a resistance applied to the recording medium varies depending on whether the recording medium is conveyed through the first/second-positions communicating path section or the first/third-positions communicating path section. This resistance, which may be referred to as "convey resistance", is a force applied to the recording medium and acting in a direction opposite to the conveyance direction, and is increased when a leading end portion of the recording medium enters into the bent path section of the conveyance path. Upon increase of the convey resistance, a velocity of the conveyed recording medium is momentarily reduced. That is, the conveyance velocity of the recording medium is momentarily drastically reduced where the recording medium is conveyed along one of the first/second-positions communicating path section and the first/third-positions communicating path section which applies a larger convey resistance to the recording medium, as compared with where the recording medium is conveyed along the other of the first/second-positions communicating path section and the first/third-positions communicating path section which applies a smaller convey resistance to the recording medium. Therefore, if the recording is continued by the first recording head onto the recording medium at the moment of change of the conveyance velocity, there is a risk that the recorded image would be disordered.

The present invention was made in view of such a background. It is therefore an object of the invention to provide an image recording apparatus in which it is possible to restrain amount of consumption of liquid and to restrain reduction of quality of recorded image by restraining momentary change of velocity of conveyed recording medium.

The above object of the invention may be achieved according to a principle of the invention, which provides an image recording apparatus including: (a) first and second recording heads each having an ejection surface through which liquid is to be ejected onto a recording medium; (b) a first-conveyance-path definer defining a first conveyance path along which the recording medium is to be conveyed via a first position and a second position such that the recording medium is opposed to the ejection surface of the first recording head when the recording medium is being positioned in the first position and such that the recording medium is opposed to the ejection surface of the second recording head when the recording medium is being positioned in the second position; (c) a second-conveyance-path definer defining a second conveyance path along which the recording medium is to be conveyed via the first position and a third position and without via the second position, the third position being other than the second position; and (d) a velocity controller configured to control a conveyance velocity at which the recording medium is to be conveyed along the first and second conveyance paths, wherein the first conveyance path includes a first/second-positions communicating path section that is located between the first and second positions while the second conveyance path includes a first/third-positions communicating path section that is located between the first and third positions, such that one of the first/second-positions communicating path section and the first/third-positions communicating path section is bent larger than the other of the first/second-positions communicating path section and the first/third-positions communicating path section, wherein the velocity controller is configured to control the conveyance velocity to a first velocity while the recording medium is being conveyed along the other of the first/second-positions communicating path section and the first/third-positions communicating path section, and wherein the velocity controller is configured to control the conveyance velocity to a second velocity that is lower than the first velocity while the recording medium is being conveyed along the one of the first/second-positions communicating path section and the first/third-positions communicating path section, in a case where the liquid is kept ejected from the first recording head upon arrival of the recording medium in the one of the first/second-positions communicating path section and the first/third-positions communicating path section.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

[First Embodiment]

(Construction of First Embodiment)

Figure 1:
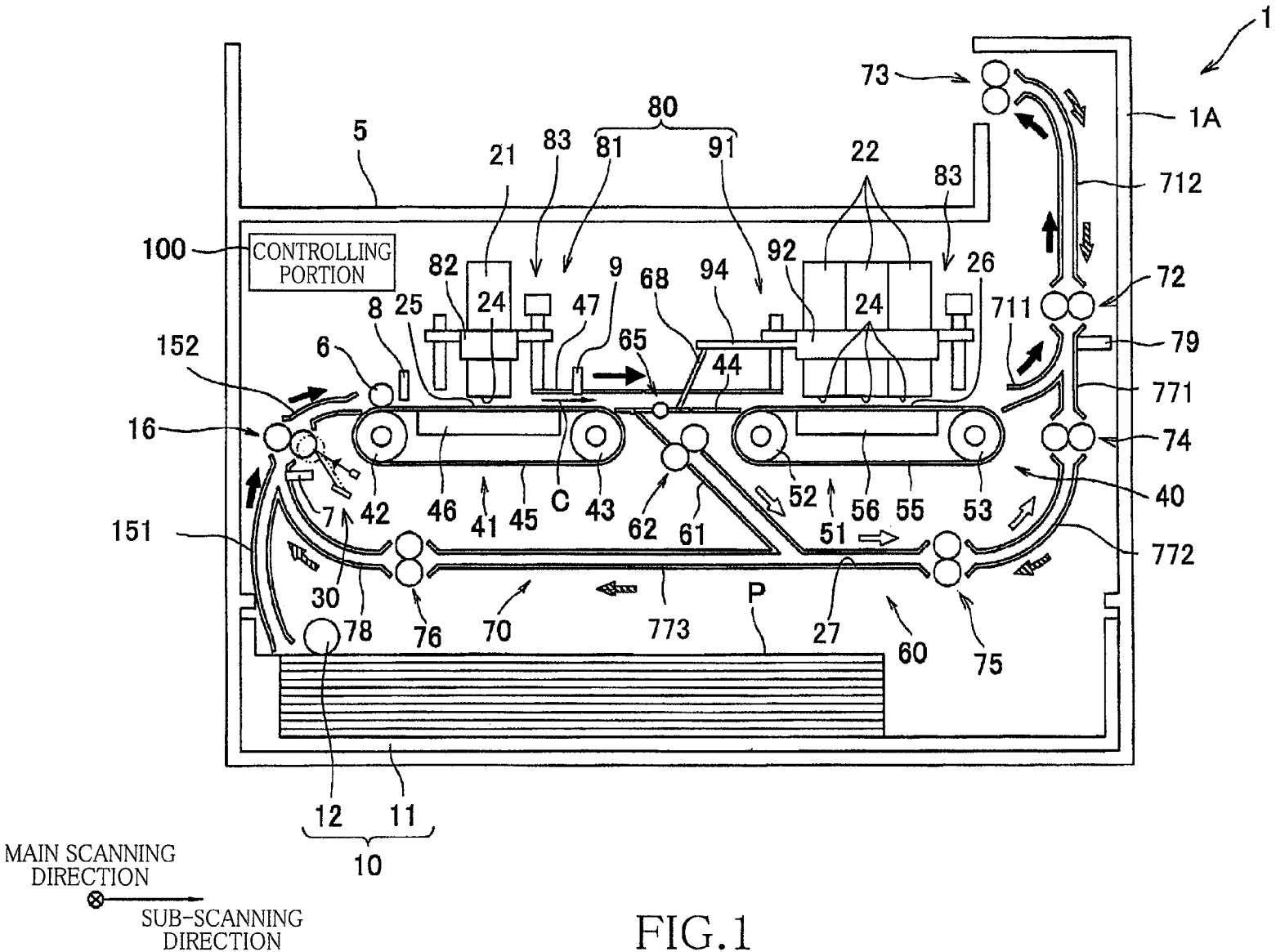
FIG. 1 is a side view schematically showing an internal construction of an inkjet printer 1 according to a first embodiment of the invention.

As shown in FIG. 1, an inkjet printer 1, which is constructed according to a first embodiment of the invention, has a generally rectangular parallelepiped-shaped housing body 1A including an upper portion that serves as a sheet exit portion 5. Within the housing body 1A, a first recording head 21 and a set of second recording heads 22 are arranged in a sub-scanning direction. The first recording head 21 is to be assigned to monochrome recording, and is configured to eject black ink. The set of second recording heads 22 consist of recording heads which are assigned to color recording and which are configured to eject magenta, cyan and yellow inks, respectively. Below these first and second recording heads 21, 22, there are disposed a first conveying mechanism 40, a second conveying mechanism 60 and a reconveying mechanism 70 which cooperate to constitute a conveyor device. The housing body 1A includes a lower portion in which a sheet supply unit 10 is disposed. Further, the inkjet printer 1 has a controlling portion 100 configured to control actuations of these components of the printer 1. The controlling portion 100 will be described below in detail.

Figure 2:
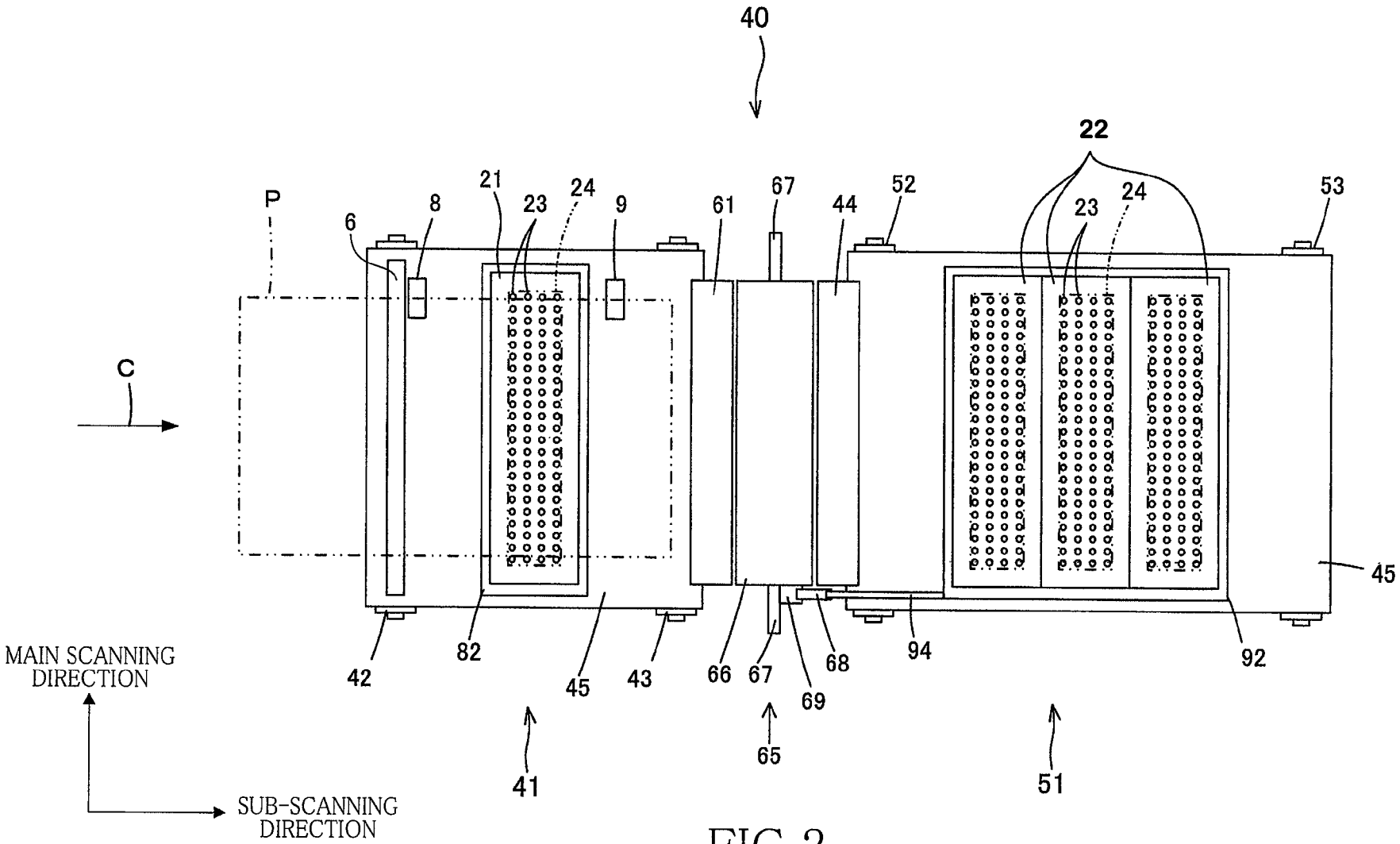
FIG. 2 is an upper plan view showing first and second recording heads 21, 22 and a first conveying mechanism 40 of the inkjet printer 1.

Each of the first and second recording heads 21, 22 has a generally rectangular parallelepiped shape, and is elongated in a main-scanning direction, as shown in FIG. 2. That is, the inkjet printer 1 is a line-type printer. In the present embodiment, the sub-scanning direction is parallel with a conveyance direction C in which a recording sheet is to be conveyed, while the main-scanning direction is orthogonal to the sub-scanning direction and is parallel to a horizontal plane. Each of the first and second recording heads 21, 22 is configured to eject, through a plurality of ink ejection holes 23, ink supplied from a corresponding one of ink tanks (not shown) that store therein respective color inks. Each of the first and second recording heads 21, 22 has a bottom face in the form of an ejection surface 24 in which the ink ejection holes 23 open. The ejection surface 24 is slightly larger than the recording sheet as measured in the main-scanning direction, so that an image can be formed on an entire surface of the recording sheet.

In the inkjet printer 1, there are defined a first conveying path, a second conveying path and a reconveying path, which are to be assigned to color recording, monochrome recording and both-side recording, respectively. The first conveying path is defined by the first conveying mechanism 40 which has a first unit 41, a second unit 51 and conveying guides 44, 47. The second conveying path is defined by the first unit 41 of the first conveying mechanism 40 and the second conveying mechanism 60 which has conveying guides 61, 771, 772 and pairs of conveying rollers 62, 74, 75. The reconveying path is defined by a reconveying mechanism 70 which has, in addition to conveying guides 711, 712 and two pairs of conveying rollers 72, 73, three pairs of conveying rollers 74, 75, 76, conveying guides 771, 772, 773 (which are disposed among the four pairs of conveying rollers 72, 74, 75, 76) and a conveying guide 78 (which is disposed between the pair of conveying rollers 76 and a pair of conveying rollers 16 and which is connected to a conveying guide 151). In the present embodiment, the first conveying mechanism 40 constitutes a first-conveyance-path definer while the second conveying mechanism 60 and the first unit 41 of the first conveying mechanism 40 cooperate to constitute a second-conveyance-path definer.

The first conveying path is a path along which the recording sheet is to be conveyed as indicated by thick arrow (black arrow) in FIG. 1. More specifically described, the first conveying path is a path along which the recording sheet (having been supplied from the sheet supply unit 10) is to be conveyed by the first conveying mechanism 40 toward the sheet exit portion 5 through a straight path section that transits positions opposed to the ejection surfaces 24 of the respective first and second recording heads 21, 22. Hereinafter, the position opposed to the ejection surface 24 of the first recording head 21 will be referred to as a first position 25 while the position opposed to the ejection surfaces 24 of the second recording heads 22 will be referred to as a second position 26. It is noted that the above-described straight path is defined between the first conveying mechanism 40 and the first and second recording heads 21, 22 in a vertical direction and extends substantially straightly in the sub-scanning direction.

The second conveying path is a path along which the recording sheet is to be conveyed as indicated by thick arrow (white arrow) in FIG. 1. More specifically described, the second conveying path is a path along which the recording sheet (having been supplied from the sheet supply unit 10) is to be conveyed by the first unit 41 of the first conveying mechanism 40 toward the sheet exit portion 5, via the first position 25 and a third position 27 (that is other than the second position 26) and without via the second position 26.

The reconveying path is a path along which the recording sheet (having been conveyed along the first or second conveying path) is to be conveyed as indicated by thick arrow (hatched arrow) in FIG. 1.

The sheet supply unit 10 has a sheet supplying cassette 11 capable of storing therein a plurality of recording sheets stacked on one another, a sheet supplying roller 12 configured to supply the recording sheets from the sheet supplying cassette 11 and a sheet supplying motor (not shown) controllable by the controlling portion 100 so as to rotate the sheet supplying roller 12.

The sheet supplying roller 12 is configured to pick up an uppermost one of the recording sheets stored in the sheet supplying cassette 11, by being rotated and brought into contact with the uppermost sheet. The conveying guides 151, 152 and the pair of conveying rollers 16 are disposed on a left side, as seen in FIG. 1, of the first conveying mechanism 40. The conveying guides 151, 152 extend upwardly from the sheet supplying cassette 11 and are curved toward the first conveying mechanism 40. The pair of conveying rollers 16 are disposed between the conveying guides 151, 152 and are located on an upstream side, as viewed in the conveyance direction C, of the first conveying mechanism 40. The conveying guides 151, 152 cooperate with the pair of conveying rollers 16 to define an upstream-side path section which is located on an upstream side, as viewed in the conveyance direction C, of the above-described straight path section and which communicates the sheet supply unit 10 and the straight path section. That is, this upstream-side path section is a path along which the recording medium is to be conveyed from the sheet supply unit 10 to the straight path section. A roller 161 (see FIG. 3), which is one of the conveying rollers 16, is a drive roller that is to be rotated by a conveying motor (not shown) controlled by the controlling portion 100. A roller 162 (see FIG. 3), which is the other of the conveying rollers 16, is a driven roller that is be rotated by rotation of the drive roller 161. Each of the rollers 161, 162 extend in the main-scanning direction. The pair of conveying rollers 16 serve as register rollers configured to correct inclination of the recording sheet when conveying the recording sheet toward the first conveying mechanism 40. A rotary shaft of the drive roller 161 is rotatably fixed to the housing body 1A, so as not to be displaceable relative to the housing body 1A. Meanwhile, a rotary shaft of the driven roller 162 is provided to be displaceable in directions toward and away from the drive roller 161, and is constantly forced by a spring (not shown) toward the drive roller 161 so as to be held in contact with the drive roller 161. A sheet detection sensor 7 as a first medium presence detector is disposed in a first medium-presence-detector position that is located on an upstream side, as viewed in the conveyance direction C, of the pair of conveying rollers 16. This sheet detection sensor 7 is configured to detect the recording sheet which has been supplied from the sheet supplying roller 12 or the reconveying path.

Figure 3:
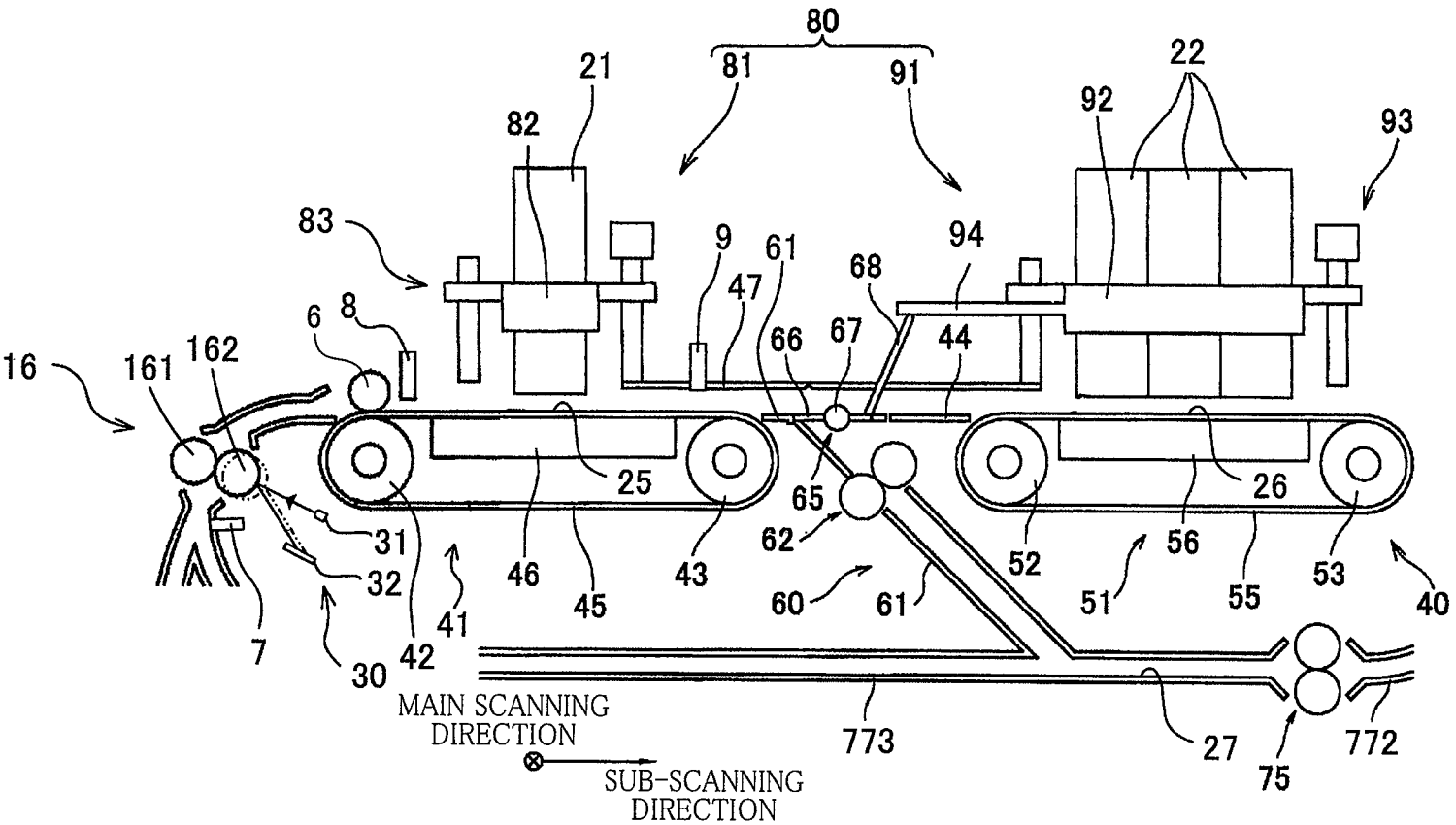
FIG. 3 is a side view of a major part of the inkjet printer 1, showing a state in which the first and second recording heads 21, 22 are not covered by first and second caps 82, 92.

As shown in FIG. 3, a sheet thickness detector 30 as a medium thickness detector is disposed in vicinity of the pair of conveying rollers 16. The sheet thickness detector 30 has a construction that is basically known, as disclosed in JP-3081517 B2, for example. The construction of the sheet thickness detector 30 will be described briefly. The sheet thickness detector 30 has a light emitting diode 31 and a light receiving sensor 32 that is configured to receive light emitted from the light emitting diode 31. The light emitting diode 31 is disposed in a position that enables an emitted light to be irradiated onto a reflection surface provided by an outer circumferential surface of the driven roller 162. The light receiving sensor 32 has a light receiving surface, and is disposed in a position that enables the light reflected from the reflection surface of the driven roller 162, to be received by the light receiving surface. The light receiving sensor 32 is configured to detect a position of a portion of the light receiving surface in which the light is actually received.

By rotation of the sheet supplying roller 12 under control by the controlling portion 100, the uppermost recording sheet is supplied from the sheet supplying cassette 11 toward the conveying guide 151. Then, the recording sheet conveyed along the conveying guide 151 is brought into contact with the pair of conveying rollers 16, so that a leading end portion of the recording sheet is made parallel to a roller extending direction (in which the rollers 16 extend), whereby inclination of the recording sheet is corrected. Thereafter, the recording sheet is conveyed to the first conveying mechanism 40 while being guided by the conveying guide 152. When the recording sheet becomes gripped between the pair of conveying rollers 16, the driven roller 162 is displaced away from the driving roller 161 by a distance corresponding to the thickness of the recording sheet, since the driven roller 162 is displaceable relative to the driving roller 161. The displacement of the driven roller 162 changes a portion of the reflection surface of the driven roller 162 in which the light emitted from the light emitting diode 31 is actually reflected. By the change of the portion of the reflection surface in which the emitted light is actually reflected, the above-described portion of the light receiving surface of the light receiving sensor 32 in which the light is actually received is changed. Thus, the controlling portion 100 determines the thickness of the conveyed recording sheet, based on the position of the portion of the light receiving surface in which the light is actually received.

As shown in FIGS. 1 and 2, the first conveying mechanism 40 defines the above-described straight path section in which there are located the above-described first and second positions 25, 26 that are opposed to the first and second recording heads 21, 22, respectively. The first conveying mechanism 40 is configured to convey the recording sheet along this straight path section in the conveyance direction C that is indicated by arrow C in FIG. 2. The first conveying mechanism 40 has the first and second units 41, 51 and the conveyance guides 44, 47. The first unit 41 is disposed in a position opposed to the first recording head 21 that is assigned to monochrome recording. The second unit 51 is disposed in a position opposed to the set of second recording heads 22 that are assigned to color recording. The conveying guide 47 is constituted by a plate-like member which is disposed between the first and second recording heads 21, 22 and which is constituted by a plate-like member bridging between the first and second units 41, 51. The conveying guide 44 is disposed on a lower side of the conveying guide 47 and is parallel to the conveying guide 47. The first and second units 41, 51 are positioned relative to each other such that the first and second positions 25, 27 are arranged in the conveyance direction C and lie on a horizontal plane. It is noted that the conveying guide 47 is not illustrated in FIG. 2, for an easier understanding.

The first unit 41 has two belt pulleys 42, 43 and an endless conveyor belt 45 that is looped around the two belt pulleys 42, 43. The first unit 41 further has a suction platen 46, a conveying motor (not shown) and an electric power source (not shown). The conveyor belt 45 is supported, at an inner circumferential surface of its upper side portion, by the suction platen 46. The conveying motor is provided for rotating the belt pulley 43. The electric power source is provided for applying electric voltage to the suction platen 46. The conveying motor and the electric power source are both controlled by the controlling portion 100. It is noted that the first position 25 is located within a region in which the conveyor belt 45 is opposed to the ejection surface 24 of the first recording head 21.

The suction platen 46 has a pair of comb-teeth-like electrodes (not shown) each of which has a plurality of elongated portions elongated in the conveyance direction C, such that the elongated portions of the respective comb-teeth-like electrodes are arranged alternately in the main-scanning direction. With application of an electric voltage between the comb-teeth-like electrodes, the recording sheet positioned above the suction platen 46 can be sucked onto the conveyor belt 45.

Like the first unit 41, the second unit 51 has two belt pulleys 52, 53 and an endless conveyor belt 55 that is looped around the two belt pulleys 52, 53. The second unit 51 further has a suction platen 56, a conveying motor (not shown) and an electric power source (not shown). The conveyor belt 55 is supported, at an inner circumferential surface of its upper side portion, by the suction platen 56. The conveying motor is provided for rotating the belt pulley 53. The electric power source is provided for applying an electric voltage to the suction platen 56. The conveying motor and the electric power source are both controlled by the controlling portion 100. The suction platen 56 has a construction similar to the construction of the suction platen 46, so that the recording sheet positioned above the suction platen 56 can be sucked onto the conveyor belt 55, with application of an electric voltage between the comb-teeth-like electrodes. It is noted that the second position 26 is located within a region in which the conveyor belt 55 is opposed to the ejection surfaces 24 of the second recording heads 22. The first conveyance path includes a first/second-positions communicating path section which communicates between the first and second positions 25, 26, and which is a straight path section that is defined by the conveying guides 47, 44 and a pivotable flapper 66 when the flapper 66 takes a second posture.

The second conveying mechanism 60 is disposed in vicinity of the second unit 51. The second conveying mechanism 60 is constituted by the conveying guide 61, the pair of conveying rollers 62 disposed in a middle of the conveying guide 61, a portion of the conveying guide 773 of the reconveying mechanism 70, the conveying guides 771, 772 and the pairs of conveying rollers 74, 75, so as to define a downstream-side portion of the second conveying path. The conveying guide 61 extends from a middle of the first conveying path that is located between the first and second units 41, 51, in a right-downward direction (as seen in FIG. 1), so as to be connected to a middle of the conveying guide 773. The conveying guide 773 includes a portion overlapping with the second position 26 in a vertical direction, and extends in the sub-scanning direction. The third position 27 is a position other than the second position 26, and is a position which the recording sheet (having been conveyed away from the first position 25) passes. The third position 27 is defined by the conveying guides 61, 772 that constitute the second conveying mechanism 60. The second conveying path includes a first/third-positions communicating path section which communicates between the first and third positions 25, 27, and which is a largely-bent path section 601 that is defined by the conveying guides 47, 61 and the pivotable flapper 66 when the flapper 66 takes a first posture. The pivotable flapper 66 will be described later. Each pair of the three pairs of conveying rollers 62, 74, 75 consist of a drive roller that is to be rotated by a conveying motor (not shown) that is controlled by the controlling portion 100 and a driven roller that is to be rotated by rotation of the drive roller. It is noted that the second conveying mechanism 60 and the reconveying mechanism 70 are partially constituted by components that are common to the second conveying and reconveying mechanisms 60, 70, and that the second conveying path and the reconveying path are partially constituted by path sections that are common to the second conveying and reconveying paths.

As shown in FIGS. 1 and 2, a pressing roller 6 is disposed in a position opposed to the belt pulley 42 that is located on one of opposite sides of the conveyor belt 45 that is remote from the pressing roller 6. The pressing roller 6 is configured to press the recording sheet (having supplied from the sheet supply unit 10) onto an outer circumferential surface of the conveyor belt 45. Between the pressing roller 6 and the first recording head 21, there is disposed another first medium presence detector in the form of a sheet detection sensor 8 that is configured to detect the recording sheet that has been pressed by the pressing roller 6. Further, another sheet detection sensor 9 as a second medium presence detector is disposed in a second medium-presence-detector position which is opposed to the conveyor belt 45 and which is located on a downstream side, as viewed in the conveyance direction C, of the first recording head 21. This sheet detection sensor 9 is configured to detect the recording sheet having passed the first position 25 that is opposed to the first recording head 21.

When a color image is to be recorded onto a recording sheet, the belt pulleys 43, 53 are rotated in clockwise direction as seen in FIG. 1 under control by the controlling portion 100 whereby the conveyor belts 45, 55 are circulated. By circulation of the conveyor belts 45, 55, the belt pulleys 42, 52 and the pressing roller 6 are also rotated. Further, upon circulation of the conveyor belts 45, 55, different levels of electric potentials are applied to the respective comb-teeth-like electrodes of each of the suction platens 46, 56 under control by the controlling portion 100, such that one of a positive electric charge and a negative electric charge is generated on an opposed portion of a corresponding one of the conveyor belts 45, 55 that is opposed to a surface of the recording sheet while the other of the positive electric charge and the negative electric charge is induced on the surface of the recording sheet opposed to the corresponding one of the conveyor belts 45, 55, whereby the recording sheet is sucked onto the corresponding one of the conveyor belts 45, 55, as a result of attraction of the opposite electric charges to each other. Thus, the recording sheet having been supplied from the sheet supply unit 10 is conveyed in the conveyance direction C while being sucked onto the conveyor belt 45, so as to pass the first position 25. Then, the recording sheet having passed the conveying guides 47, 44 is conveyed further in the conveyance direction C while being sucked onto the conveyor belt 55, so as to pass the second position 26. That is, after having being supplied from the sheet supply unit 10, the recording sheet is caused to pass the straight pass section that transits the first and second positions 25, 26, and is conveyed along the first conveying path toward the sheet exit portion 5. While the recording sheet is being thus conveyed while being sucked onto the conveyor belts 45, 55, the first recording head 21 is caused by the controlling portion 100 to eject black ink toward the recording sheet when the recording sheet is passing the first position 25, and the second recording heads 22 are caused by the controlling portion 100 to eject inks of the respective colors toward the recording sheet when the recording sheet is passing the second position 26, so that a desired color image is formed on the recording sheet.

On the other hand, when a monochrome image is to be recorded onto a recording sheet, the controlling portion 100 controls the pairs of conveying rollers 62, 74, 75 and a fork 65 (described below) such that the conveying rollers 62, 74, 75 are rotated while the fork 65 is caused to guide the recording sheet (having been conveyed by the first unit 41) toward the conveying guide 61. That is, the recording sheet having been supplied from the sheet supply unit 10 is conveyed in the conveyance direction C while being sucked onto the conveyor belt 45, so as to be firstly caused to pass the first position 25. Then, the recording sheet is conveyed along the second conveying path which diverges from the straight path section at the fork 65 located between the first and second units 41, 51, and which transits the third position 27. The recording sheet having been conveyed along the second convey path is received into the first conveying path, on a downstream side, as viewed in the conveyance direction C, of the straight path section. Since the recording sheet does not pass the second position 26 that is opposed to the second recording heads 22 assigned to color recording, only a desired monochrome image is formed on the recording sheet.

As shown in FIG. 1, on a right side of the second recording heads 22, there are disposed the above-described conveying guides 711, 712 and two pairs of conveying rollers 72, 73 which cooperate to constitute a part of the reconveying mechanism 70. The conveying guides 711, 712 extend curvedly from the first conveying mechanism 40 toward the sheet exit portion 5. The conveying guides 711, 712 and two pairs of conveying rollers 72, 73 cooperate to constitute a part of the reconveying path and also a part of the first conveying path. Each pair of the two pairs of conveying rollers 72, 73 consist of a drive roller that is to be rotated by a conveying motor (not shown) that is controlled by the controlling portion 100 and a driven roller that is to be rotated by rotation of the drive roller. A sheet detection sensor 79 is disposed in vicinity of the pair of conveying rollers 72. This sheet detection sensor 79 is configured to detect a trailing end portion of the recording sheet that has been conveyed by the first conveying mechanism 40 or second conveying mechanism 60.

The two pairs of conveying rollers 72, 73 (which are disposed on a downstream side, as viewed in the conveyance direction C, of the first and second conveying mechanisms 40, 60) are rotated in predetermined directions under control by the controlling portion 100, whereby the recording sheet having been conveyed from the first conveying mechanism 40 or second conveying mechanism 60 are conveyed upwardly as seen in FIG. 1 along the conveying guides 711, 712 while being gripped by the conveying rollers 72, 73, so as to be eventually discharged to the sheet exit portion 5. When the image is to be formed on a bottom face of the recording sheet (which is opposite to a top face having the image already recorded thereon) without the recording sheet being discharged to the sheet exit portion 5, the controlling portion 100 is configured, upon arrival of the trailing end portion of the recording sheet in vicinity of the pair of conveying rollers 72, to control the two pairs of conveying rollers 72, 73 such that the conveying rollers 72, 73 are rotated in directions that are opposite to the above-described predetermined directions, whereby the recording sheet is conveyed in a reverse direction as indicated by thick arrow (hatched arrow) in FIG. 1.

As shown in FIG. 1, the reconveying mechanism 70 has the above-described conveying guides 711, 712, two pairs of conveying rollers 72, 73, three pairs of conveying rollers 74, 75, 76, conveying guides 771, 772, 773 (that are disposed among the four pairs of conveying rollers 72, 74, 75, 76) and conveying guide 78 (which is disposed between the pair of conveying rollers 76 and the pair of conveying rollers 16, and which is connected to the conveying guide 151). It is noted that the pair of conveying rollers 76 consist of a drive roller that is to be rotated by a conveying motor (not shown) that is controlled by the controlling portion 100 and a driven roller that is to be rotated by rotation of the drive roller. It is noted that a part of the conveying guide 773, conveying guides 771, 772 and pairs of conveying rollers 74, 75 serve as the above-described second conveying mechanism 60 as well as the reconveying mechanism 70.

The three pairs of conveying rollers 74, 75, 76 are rotated under control by the controlling portion 100, whereby the recording sheet (having been conveyed in the reverse direction away from the sheet exit portion 5) is conveyed along the conveying guide 771, 772, 773, 78 toward the pair of conveying rollers 16 while being gripped by the pairs of conveying rollers 74, 75, 76. Then, the pair of conveying rollers 16 are rotated under control by the controlling portion 100, whereby the recording sheet (with the top face having the image recorded thereon) is reconveyed to the upstream side, as viewed in conveyance direction C, of the first conveying mechanism 40. In this instance, when the recording sheet is conveyed to the first conveying mechanism 40, the recording sheet is inverted such that the bottom face faces upwardly while the top face (that used to face upwardly when the recording sheet had been supplied from the sheet supply unit 10) faces downwardly.

As shown in FIGS. 1 and 2, the inkjet printer 1 has a maintenance unit 80 configured to carry out maintenance operations onto the first and second recording heads 21, 22. The maintenance unit 80 has a first capping mechanism 81 and a second capping mechanism 91. The first capping mechanism 81 is provided to restrain undesirable increase of viscosity of the ink in vicinity of openings of the ink ejection holes 23 of the first recording head 21 assigned to monochrome recording. The second capping mechanism 91 is provided to restrain undesirable increase of viscosity of the ink in vicinity of openings of the ink ejection holes 23 of the second recording heads 22 assigned to color recording.

As shown in FIGS. 2 and 3, the first capping mechanism 81 has an annular-shaped first cap 82 and a first moving mechanism 83. The annular-shaped first cap 82 is disposed in periphery of the first recording head 21. The first moving mechanism 83 includes a motor (not shown) configured to vertically move the first cap 82. The first cap 82 has a lower end portion that is formed of an elastic member such as a rubber.

When the first cap 82 is moved downwardly by the first moving mechanism 83 under control by the controlling portion 100, the first cap 82 is moved from a non-working position (as shown in FIG. 3) in which the first cap 82 is separated from the conveyor belt 45, to a working position (not shown) in which the first cap 82 is in close contact at its lower end portion with the conveyor belt 45. When the first cap 82 is being positioned in the working position, the ejection surface 24 of the first recording head 21 is closed by an outer circumferential surface of the conveyor belt 45 and an inner wall of the first cap 82 which cooperate with each other to surround the ejection surface 24. When the first cap 82 is being positioned in the non-working position, the ejection surface 24 is not closed. Thus, with the first cap 82 being positioned in the working position, it is possible to restrain increase of the viscosity of the ink in vicinity of the openings of the ink ejection holes 23 of the first recording head 21. On the other hand, when the first cap 82 is moved upwardly by the first moving mechanism 83 under control by the controlling portion 100, the first cap 82 is moved from the working position to the non-working position.

As shown in FIGS. 2 and 3, the second capping mechanism 91 has an annular-shaped second cap 92 and a second moving mechanism 93. The annular-shaped second cap 92 is disposed in periphery of the set of second recording heads 22. The second moving mechanism 93 includes a motor (not shown) configured to vertically move the second cap 92. The second cap 92 has a lower end portion that is formed of an elastic member such as a rubber. A projection 94 is provided to project in the sub-scanning direction from a corner portion of the second cap 92 which corresponds to a lower left end portion, as seen in FIG. 2, of the second cap 92. The projection 94 is movable vertically together with vertical movement of the second cap 92.

When the second cap 92 is moved downwardly by the second moving mechanism 93 under control by the controlling portion 100, the second cap 92 is moved from a non-working position (as shown in FIG. 3) in which the second cap 92 is separated from the conveyor belt 55, to a working position (as shown in FIG. 3) in which the second cap 92 is in close contact at its lower end portion with the conveyor belt 55. When the second cap 92 is being positioned in the working position, the ejection surfaces 24 of the second recording heads 22 are closed by an outer circumferential surface of the conveyor belt 55 and an inner wall of the second cap 92 which cooperate with each other to surround the ejection surfaces 24. When the second cap 92 is being positioned in the non-working position, the ejection surfaces 24 are not closed. Thus, with the second cap 92 being positioned in the working position, it is possible to restrain undesirable increase of the viscosity of the ink in vicinity of the openings of the ink ejection holes 23 of the second recording heads 22. On the other hand, when the second cap 92 is moved upwardly by the second moving mechanism 93 under control by the controlling portion 100, the second cap 92 is moved from the working position to the non-working position.

The above-described fork 65 is located in a position which lies between the first and second units 41, 51 and which lies in vicinity of an upper end portion of the conveying guide 61. The conveyance direction C of the recording sheet having passed the first position 25 is switchable, in the fork 65, between two directions, one of which is toward the second position 26 and the other of which is toward the third position 27. In the fork 65, there are disposed a plate-like shaped pivotable flapper 66, two rotary shafts 67 and a lever 68, as shown in FIGS. 2 and 3. The flapper 66 is disposed between an upper end portion of the conveying guide 61 and the conveying guide 44. The two rotary shafts 67 are fixed to opposite end portions, as viewed in the main-scanning direction, of the flapper 66. The two rotary shafts 67 are rotatably held at their distal end portions by the housing body 1A.

Figure 4:
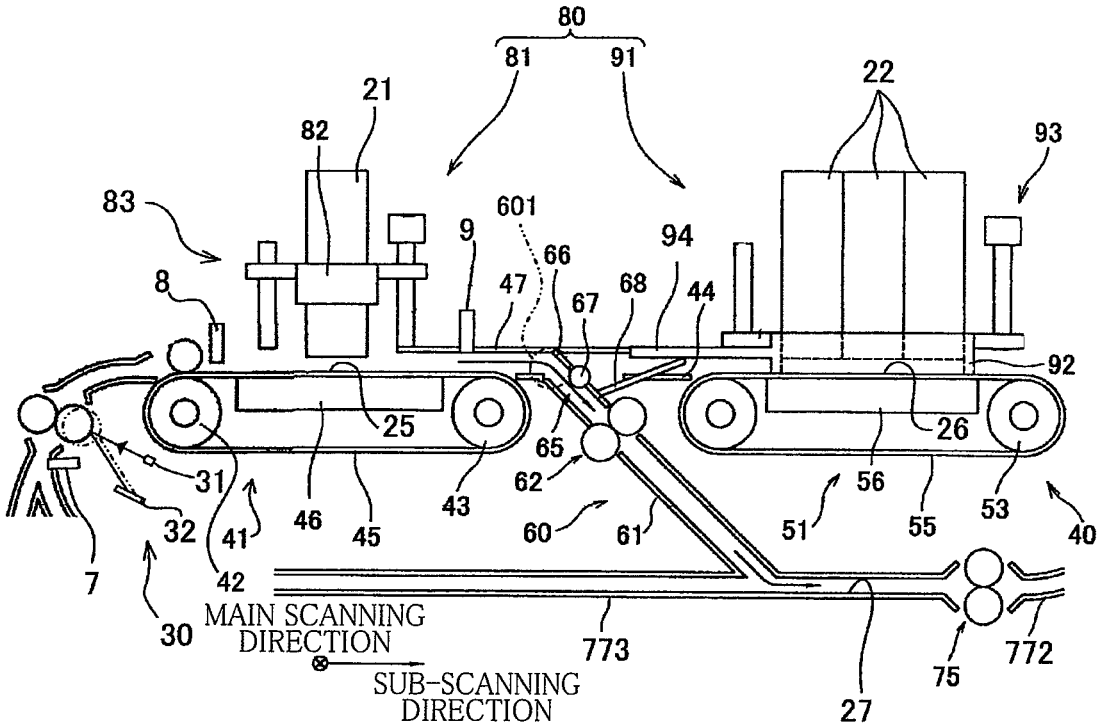
FIG. 4 is a side view of the major part of the inkjet printer 1, showing a state in which the first recording head 21 is not covered by the first cap 82 while the second recording heads 22 are covered by the second cap 92.

The pivotable flapper 66 is pivotable about the two rotary shafts 67, so as to selectively take a first posture (as shown in FIG. 4) and a second posture (as shown in FIG. 3). When taking the first posture, the flapper 66 closes the straight path section that transits the first and second positions 25, 26. When taking the second posture, the flapper 66 opens the straight path section that transits the first and second positions 25, 26. Described more specifically, when the flapper 66 takes the first posture, as shown in FIG. 4, the flapper 66 is inclined so as to become parallel to the conveying guide 61, such that an upper end portion (i.e., upstream end portion) of the flapper 66 is in contact with the conveying guide 47, and such that a lower end portion (i.e., downstream end portion) of the flapper 66 is positioned in vicinity of an upper one of the conveying rollers 62. That is, when the flapper 66 takes the first posture, the straight path section transiting the first and second positions 25, 26 is closed while the second conveying path transiting the first and third positions 25, 27 is opened. On the other hand, when the flapper 66 takes the second posture, as shown in FIGS. 1 and 3, the flapper 66 extends in a horizontal direction, such that the flapper 66 is parallel to the conveying guide 47, and such that the flapper 66 bridges between an upper end portion of the conveying guide 61 and the conveying guide 44. That is, when the flapper 66 takes the second posture, the straight path section transiting the first and second positions 25, 26 is opened while the second conveying path transiting the first and third positions 25, 27 is closed. It is noted that the fork 65 is located relative to the first position 25 such that, when a leading end portion of a A4-sized recording sheet arrives in the fork 65, at least a trailing end portion of the A4-sized recording sheet is positioned in the first position 25.

The lever 68 is fixed to a projection 69 which is provided in one of end portions of the pivotable flapper 66 which are opposite to each other in the main-scanning direction, namely, which is provided in a lower end portion, as seen in FIG. 2, of the flapper 66. As shown in FIG. 3, the lever 68 extends from the projection 69 in an upper right direction such that the lever 68 is in contact with the projection 94 projecting from the second cap 92.

When the second cap 92 is moved from the non-working position to the working position, the lever 68 is pivoted downwardly whereby the pivotable flapper 66 is pivoted such that the second posture is switched to the first posture. That is, the flapper 66 becomes inclined with respect to a horizontal direction, so as to close the straight path section. When the recording sheet is conveyed by the conveyor belt 45 of the first unit 41 and arrives in the fork 65 via the first position 25 while the flapper 66 is taking the first posture, the leading end portion of the recording sheet is caused to collide with the flapper 66. Then, the conveyance direction C of the recording sheet is changed in accordance with the first posture of the flapper 66, such that the recording sheet is conveyed along the second conveying path toward the third position 27. That is, the second conveying path is largely bent by the flapper 66 taking the first posture. In other words, the second conveying path includes the bent path section 601 that is defined by the flapper 66 taking the first posture. When the recording sheet (having been conveyed via the first position 25) is conveyed along the bent path section 601 that is defined by the flapper 66 taking the first posture, the leading end portion of the recording sheet is caused to collide with the flapper 66. In this instance, a large convey resistance is applied to the recording sheet, due to its collision with the flapper 66. The convey resistance is a resistance which is applied to the recording sheet and which acts in a direction opposite to the conveyance direction C. Upon generation of the large convey resistance as a result of collision of the recording sheet with the flapper 66 taking the first posture, the recording sheet is momentarily stopped. That is, upon collision of the recording sheet with the flapper 66, the conveyance velocity of the recording sheet is momentarily drastically reduced.

On the other hand, when the second cap 92 is moved from the working position to the non-working position, the lever 68 is pivoted upwardly whereby the pivotable flapper 66 is pivoted such that the first posture is switched to the second posture. That is, the flapper 66 becomes parallel to a horizontal direction, so as to open the straight path section. When the recording sheet is conveyed by the conveyor belt 45 of the first unit 41 and arrives in the fork 65 via the first position 25 while the flapper 66 is taking the second posture, the recording sheet is guided by the flapper 66 taking the second posture so as to be horizontally conveyed along the straight path section toward the second position 26. That is, when the recording sheet is guided by the flapper 66 taking the second posture, the conveyance direction C of the recording sheet is not abruptly changed by the flapper 66. In other words, when being guided by the flapper 66 taking the second posture so as to be conveyed along the straight path section, the recording sheet is conveyed toward the second position 26 without the large convey resistance being applied to the recording sheet.

Figure 5:
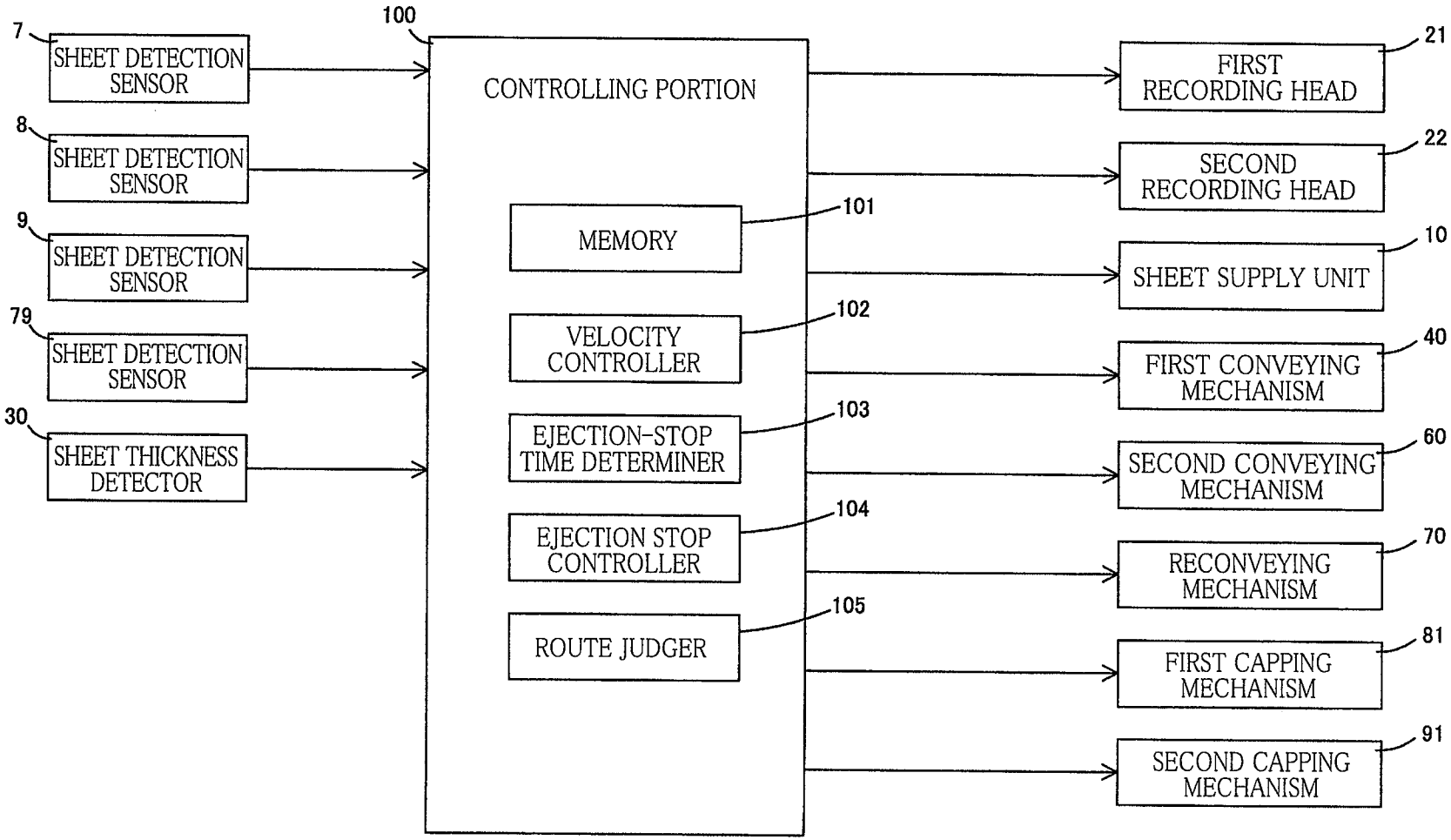
FIG. 5 is a block diagram showing a control system of the inkjet printer 1.

There will be next described the controlling portion 100 of the inkjet printer 1, with reference to FIG. 5. The controlling portion 100 is configured to control actuations of components of the printer 1, and is constituted by a plurality of hardwares such as CPU (Central Processing Unit) (not shown), RAM (Random Access Memory) (not shown) and ROM (Read Only Memory) (not shown). The ROM stores therein various kinds of softwares configured to control the inkjet printer 1. The softwares and hardwares cooperate to establish, in the controlling portion 100, a memory 101, a velocity controller 102, an ejection-stop time determiner 103, an ejection stop controller 104 and a route judger 105. The controlling portion 100 includes, in addition to these components 101-105, other components which are assigned to carry out various procedures such as controls of actuations of components of the printer 1.

The memory 101 is configured to memorize an arrival time and a conveyance-stop time, namely, stores therein data representing the arrival time and data representing the conveyance-stop time. Further, the memory 101 stores therein data required for controlling the image that is to be recorded onto the recording sheet and controlling actuations of components of the printer 1 such as the above-described first and second recording heads 21, 22, sheet supply unit 10, first and second conveying mechanisms 40, 60, reconveying mechanism 70, sheet exit portion 5 and first and second capping mechanisms 81, 91.

The above-described arrival time, which is to be memorized by the memory 101, is a length of time from detection of the leading end portion of the recording sheet (conveyed at a second conveyance velocity) by the sheet detection sensor 8 until arrival of the leading end portion of the recording sheet in the pivotable flapper 66 taking the first posture.

The above-described conveyance-stop time, which is to be also memorized by the memory 101, is a length of time, for which the conveyance of the recording sheet (that has been conveyed via the first position 25) is to be stopped upon collision of the recording sheet with the pivotable flapper 66 taking the first posture. The conveyance-stop time varies depending on the thickness of the recording sheet. The conveyance-stop time is increased with increase of the thickness of the recording sheet, since the increase of the thickness of the recording sheet leads to increase of the convey resistance that is applied to the recording sheet upon collision of the recording sheet with the flapper 66 taking the first posture. The memory 101 stores therein a table representing a relationship between the conveyance-stop time and the thickness of the recording sheet, so that the ejection-stop time determiner 103 can determine an ejection-stop time based on the thickness of the recording sheet. It is noted that the conveyance-stop time varies not only depending on the thickness of the recording sheet, but also depending on accuracies of dimensions of components (e.g., rollers and guides) of the inkjet printer 1 and accuracies of assembling of the components of the inkjet printer 1. Thus, the conveyance-stop time varies from inkjet printer to inkjet printer. Therefore, after the inkjet printers 1 have been assembled, each one of the inkjet printers 1 is subjected to a test recording in which a test pattern image is recorded onto the recording sheet by the first recording head 21 while the recording sheet is being conveyed along the second conveying path at the second conveyance velocity. Then, the conveyance-stop time, which is to be memorized by the memory 101 of each one of the inkjet printers 1, is determined, based on result of the test recording carried out in the same inkjet printer 1, by an operator or an external measurement device. It is further noted that the conveyance-stop time, which is to be memorized by the memory 101 of each one of the inkjet printers 1, does not necessarily have to be a length of time determined based on the result of the test recording carried out in the same inkjet printer 1, but may be an average of the lengths of times determined for the plurality of inkjet printers 1, based on the results of the test recordings carried out in the respective inkjet printers 1, or may be a predetermined length of time.

The route judger 105 is configured to judge whether the recording sheet is to be conveyed along the first conveying path or conveyed along the second conveying path, by judging whether a color image is to be recorded onto the recording sheet or a monochrome image is to be recorded onto the recording sheet. The route judger 105 is configured, when a command requesting execution of an image recording is inputted to the controlling portion 100 by operation of an operator, to judge whether the input command requests execution of a color image recording or a monochrome image recording. The route judger 105 judges that the recording sheet is to be conveyed along the first conveying path when having judged that the input command requests execution of the color image recording, and judges that the recording sheet is to be conveyed along the second conveying path when having judged that the input command requests execution of the monochrome image recording.

The velocity controller 102 is configured to control the conveyance velocity at which the recording sheet is to be conveyed along the first and second conveying paths. When the recording sheet is conveyed along the first conveying path, namely, when a color image is recorded onto the recording sheet, the velocity controller 102 controls actuation of the first conveying mechanism 40 such that the conveyance velocity of the recording sheet is equal to a first conveyance velocity that is higher than the above-described second conveyance velocity. On the other hand, when the recording sheet is conveyed along the second conveying path, namely, when a monochrome image is recorded onto the recording sheet, the velocity controller 102 controls actuations of the first and second conveying mechanisms 40, 60 such that the conveyance velocity of the recording sheet is equal to the second conveyance velocity in a second velocity stage since the leading end portion of the recording sheet is detected by the sheet detection sensor 7 (that is disposed on an upstream side, as viewed in the conveyance direction C, of the pair of conveying rollers 16) until the trailing end portion of the recording sheet is detected by the sheet detection sensor 9 (that is disposed on a downstream side, as viewed in the conveyance direction C, of the first recording head 21). The first conveyance velocity is a velocity that enables an image to be recorded onto 100 recording sheets per one minute (100 sheets/minute). The second conveyance velocity is a velocity that enables an image to be recorded onto 80 recording sheets per one minute (80 sheets/minute). However, the first and second conveyance velocities do not necessarily have to be such velocities, but may be other velocities as long as the second conveyance velocity is lower than the first conveyance velocity.

The ejection-stop time determiner 103 is configured, where the recording sheet is to be conveyed along the second conveying path, to determine an ejection-stop time, according to the above-described table stored in the memory 101, based on the thickness of the recording sheet detected by the sheet thickness detector 30.

The ejection stop controller 104 is configured, upon arrival of the leading end portion of the recording sheet in the pivotable flapper 66 taking the first posture where the recording sheet is to be conveyed along the second conveying path, to stop ejection of ink from the first recording head 21 for the ejection-stop time determined by the ejection-stop time determiner 103.

(Image Recordings in First Embodiment)

There will be described image recordings that are to be executed under control by the controlling portion 100. When a command requesting execution of image recording is inputted to the controlling portion 100 from PC (personal computer), for example, by operation of an operator, the route judger 105 judges whether the inputted command requests execution of color image recording or execution of monochrome image recording. Where the inputted command requests execution of color image recording, the controlling portion 100 controls the first and second capping mechanisms 81, 91 such that the first and second caps 82, 92 are positioned in their non-working positions. On the other hand, where the inputted command requests execution of monochrome image recording, the controlling portion 100 controls the first and second capping mechanisms 81, 91 such that the first cap 82 is positioned in the non-working position while the second cap 92 is positioned in the working position.

(Color Image Recording)

There will be described color image recording executed under control by the controlling portion 100. During execution of the color image recording, the first and second caps 82, 92 are positioned in their non-working positions, so that the recording sheet is conveyed along the first conveying path. The controlling portion 100 controls the sheet supply unit 10 such that the recording sheet is conveyed from the sheet supplying cassette 11 toward the conveying guide 151. Then, the controlling portion 100 controls the pair of conveying rollers 16 such that the conveying rollers 16 are stopped or rotated in reverse directions for a length of time after detection of the leading end portion of the recording sheet by the sheet detection sensor 7. Then, the controlling portion 100 controls the pair of conveying rollers 16 such that the recording sheet, whose inclination has been corrected by the conveying rollers 16, is conveyed by the conveying rollers 16 toward the first conveying mechanism 40. The above-described length of time (for which the conveying rollers 16 are stopped or rotated in the reverse directions) is a length of time which is memorized in the memory 101 and which is required for correcting inclination of the recording sheet whose leading end portion has been detected by the sheet detection sensor 7.

The controlling portion 100 controls the first conveying mechanism 40 such that the recording sheet is conveyed in the conveyance direction C while being sucked onto the conveyor belts 45, 55. The controlling portion 100 controls the first and second recording heads 21, 22 such that the first and second recording heads 21, 22 begin to eject inks when respective lengths of time have elapsed from detection of the leading end portion of the recording sheet by the sheet detection sensor 8, namely, when the recording sheet is to be positioned in regions opposed to the respective first and second recording heads 21, 22. The lengths of time are lengths of time which are memorized in the memory 101 and which are required for the recording sheet to be positioned in the regions opposed to the respective first and second recording heads 21, 22 from detection of the leading end portion of the recording sheet by the sheet detection sensor 8. Thus, with the components of the inkjet printer 1 being controlled by the controlling portion 100, a color image is recorded on a desired portion of a surface of the recording sheet. When the recording sheet is conveyed from the first unit 41 to the second unit 51, the pivotable flapper 66 takes the second posture whereby the recording sheet is conveyed following the second posture of the flapper 66 so as to pass over the flapper 66. In this instance, the conveyance direction C of the recording sheet is not abruptly changed by the flapper 66, so that the recording sheet is conveyed toward the second unit 51 without a large convey resistance being applied to the recording sheet.

The controlling portion 100 controls the pairs of conveying rollers 72, 73 such that the recording sheet is conveyed away from the conveyor belt 55 toward the sheet exit portion 5 via the conveying guides 711, 712. Where one-side recording is requested by the above-described command, the conveying rollers 72, 73 are controlled, by the controlling portion 100, so as to discharge the recording sheet toward the sheet exit portion 5. On the other hand, where both-side recording is requested by the above-described command, the controlling portion 100 controls the pair of conveying rollers 73 such that, upon detection of the trailing end portion of the recording sheet by the sheet detection sensor 79, the conveying rollers 73 are rotated in reverse directions (that are opposite to forward directions in which the conveying rollers 73 have been rotated for conveying the recording sheet toward the sheet exit portion 5).

The controlling portion 100 controls the pairs of conveying rollers 74, 75, 76 such that the recording sheet is conveyed back to the pair of conveying rollers 16 via the conveying guides 771, 772, 773, 78. Then, the pair of conveying rollers 16, first conveying mechanism 40 and first and second recording heads 21, 22 are controlled by the controlling portion 100 in substantially the same manner as when the color image has been recorded onto the top face of the recording sheet, such that a desired color image is recorded onto the bottom face of the recording sheet. The recording sheet, which has been conveyed along the reconveying path, is inverted whereby the top and bottom faces of the recording sheet are caused to face downwardly and upwardly, respectively, so that the image is recorded onto the bottom face of the recording sheet when the recording sheet is passing the regions opposed to the first and second recording heads 21, 22.

The controlling portion 100 controls the pairs of conveying rollers 72, 73 such that the recording sheet (in which the image has been recorded onto the top and bottom faces) is discharged toward the sheet exit portion 5. Thus, the both-side color recording onto the recording sheet is completed. It is noted that, in case of color recording, the actuations of the components of the inkjet printer 1 are controlled by the velocity controller 102 such that the recording sheet is conveyed at the first conveyance velocity.

(Monochrome Image Recording)

Figure 6:
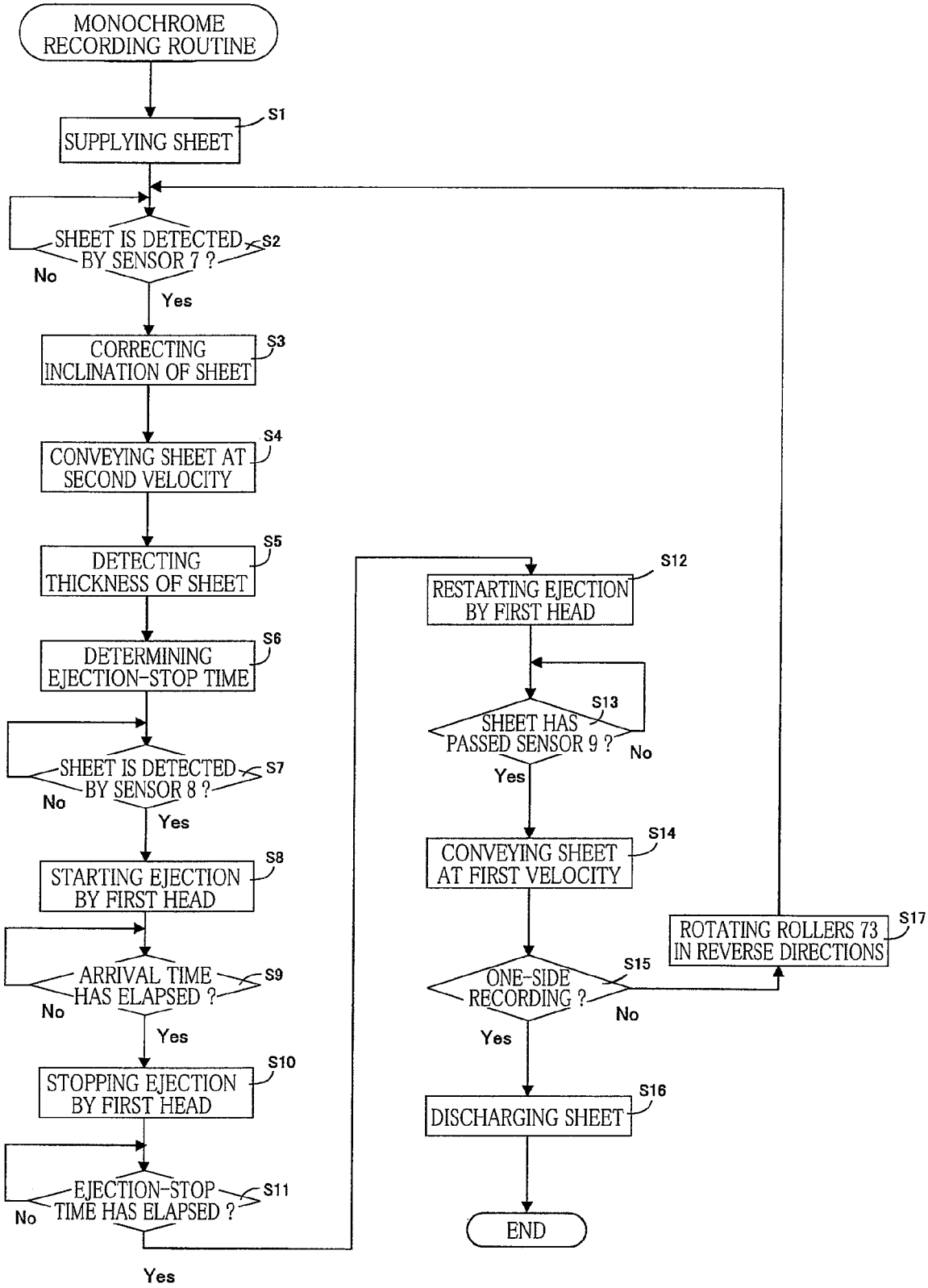
FIG. 6 is a flow chart showing a monochrome recording routine that is to be carried out by a controlling portion 100.

There will be described monochrome image recording executed under control by the controlling portion 100, with reference to a flow chart of FIG. 6 showing a monochrome recording routine. During execution of the monochrome image recording, the first cap 82 is positioned in the non-working position while the second cap 92 is positioned in the working position, so that the recording sheet is conveyed along the second conveyance path.

The monochrome recording routine is initiated with step S1 in which the controlling portion 100 controls the sheet supply unit 10 such that the recording sheet is conveyed from the sheet supplying cassette 11 toward the conveying guide 151. In this step S1, the sheet supply unit 10 is actuated in substantially the same manner as in case of color image recording, so that the recording sheet is conveyed from the sheet supplying cassette 11 toward the conveying guide 151 at the first conveyance velocity. Step S1 is followed by step S2 in which the controlling portion 100 judges whether the leading end portion of the recording sheet has been detected by the sheet detection sensor 7. As long as the leading end portion of the recording sheet has not yet detected by the sheet detection sensor 7, namely, as long as a negative judgment (NO) is obtained in step S2, the controlling portion 100 implements step S2 repeatedly. When the leading end portion of the recording sheet has been detected by the sheet detection sensor 7, namely, when a positive judgment (YES) is obtained in step S2, the control flow goes to step S3 in which the controlling portion 100 causes the pair of conveying rollers 16 to be stopped or rotated in the reverse directions for a given length of time, whereby inclination of the recording sheet is corrected by the pair of conveying rollers 16.

Then, in step S4, the controlling portion 100 controls the pair of conveying rollers 16 and the first unit 41 such that the recording sheet is conveyed by the conveying rollers 16 and the first unit 41 at the second conveyance velocity (that is lower than the first conveyance velocity) in the conveyance direction C. It is noted that, in a stage from step S4 to step S13, the velocity controller 102 controls actuations of the components of the inkjet printer 1 such that the conveyance velocity of the recording sheet P is equal to the second conveyance velocity. It is further noted that the recording sheet P is conveyed in the conveyance direction C while being sucked onto the conveyor belt 45 of the first unit 41, as in the same manner as in case of color image recording.

In step S5 following step S4, the controlling portion 100 causes the sheet thickness detector 30 to detect the thickness of the recording sheet gripped by the pair of conveying rollers 16. Then, in step S6, the controlling portion 100 causes the ejection-stop time determiner 103 to determine the ejection stop time, based on the thickness of the recording sheet detected by the sheet thickness detector 30.

In step S7, the controlling portion 100 judges whether the leading end portion of the recording sheet has been detected by the sheet detection sensor 8. As long as the leading end portion of the recording sheet has not yet been detected by the sheet detection sensor 8, namely, as long as a negative judgment (NO) is obtained in step S7, the controlling portion 100 implements step S7 repeatedly. When the leading end portion of the recording sheet has been detected by the sheet detection sensor 8, namely, when a positive judgment (YES) is obtained in step S7, the control flow goes to step S8 in which the controlling portion 100 controls the first recording head 21 such that the first recording head 21 starts ejecting ink when a given length of time has elapsed from the detection of the leading end portion of the recording sheet by the sheet detection sensor 8, namely, when the recording sheet is passing the region that is opposed to the first recording head 21.

In step S9, the controlling portion 100 judges whether a given length of time (i.e., arrival time) has elapsed from the detection of the leading end portion of the recording sheet by the sheet detection sensor 8. This given length of time is a length of time which is memorized in the memory 101 and which is required for the recording sheet to arrive in the pivotable flapper 66 taking the first posture, from the detection of the leading end portion of the recording sheet by the sheet detection sensor 8. As long as the given length of time has not yet elapsed from detection of the leading end portion of the recording sheet by the sheet detection sensor 8, namely, as long as a negative judgment (NO) is obtained in step S9, the controlling portion 100 implements step S9 repeatedly. When the given length of time has elapsed from the detection of the leading end portion of the recording sheet by the sheet detection sensor 8, namely, when a positive judgment (YES) is obtained in step S9, the control flow goes to step S10 in which the controlling portion 100 controls the first recording head 21 such that ejection of the ink from the first recording head 21 is stopped. In this instance, the straight path section is closed by the flapper 66 taking the first posture, so that the leading end portion of the recording sheet (having been conveyed by the conveyor belt 45 of the first unit 41) is caused to collide with the flapper 66 having the first posture. Thereafter, the conveyance direction C of the recording sheet is changed in accordance with the first posture of the flapper 66, whereby the recording sheet is conveyed along the second conveying path toward the third position 27. In this instance, the conveyance velocity of the recording sheet upon collision of the recording sheet with the flapper 66 is the second conveyance velocity that is lower than the first conveyance velocity, so that the conveyance resistance applied to the recording sheet due to the collision with the flapper 66 is smaller than in a case where the conveyance velocity of the recording sheet upon collision with the flapper 66 is the first conveyance velocity. It is therefore possible to restrain the conveyance velocity of the recording sheet from being momentarily drastically reduced, and accordingly to restrain disorder of the image recorded by the first recording head 21 onto the recording sheet.

Step S10 is followed by step S11 in which the controlling portion 100 judges whether the ejection stop time (determined in step S6) has elapsed since the ejection of the ink from the first recording head 21 had been stopped in step S10. As long as the ejection stop time has not yet elapsed, namely, as long as a negative judgment (NO) is obtained in step S11, the controlling portion 100 implements step S11 repeatedly. When the ejection stop time has elapsed, namely, when a positive judgment (YES) is obtained in step S11, the control flow goes to step S12 in which the controlling portion 100 controls the first recording head 21 such that the ejection of the ink from the first recording head 21 is restarted. As described above, since the conveyance velocity of the recording sheet upon collision with the pivotable flapper 66 is the second conveyance velocity that is lower than the first conveyance velocity, the momentary reduction of the conveyance velocity is retrained. However, the convey resistance, which is applied to the recording sheet upon collision with the flapper 66, is not completely eliminated, so that the conveyance velocity of the recording sheet upon collision with the flapper 66 is somewhat reduced, and the conveyance of the recording sheet is stopped upon collision with the flapper 66. Therefore, in the present embodiment, the ink ejection from the first recording head 21 is momentarily stopped while the conveyance of the recording sheet is momentarily stopped, and the ink ejection from the first recording head 21 is restarted when the conveyance of the recording sheet is restarted, so that it is possible to prevent disorder of the image recorded on the recording sheet.

The controlling portion 100 controls the pair of conveying rollers 62, 75, 74, 72, 73 such that the recording sheet (having passed the first recording head 21) is conveyed toward the sheet exit portion 5 by the second conveying mechanism 60. Step S12 is followed by step S13 in which the controlling portion 100 judges whether the trailing end portion of the recording sheet has passed the sheet detection sensor 9. As long as the trailing end portion of the recording sheet has not yet passed the sheet detection sensor 9, namely, as long as a negative judgment (NO) is obtained in step S13, the controlling portion 100 causes the recording sheet to be continued to be conveyed at the second conveyance velocity by the pairs of conveying rollers 62, 75, 74, 72, 73. When the trailing end portion of the recording sheet has passed the sheet detection sensor 9, namely, when a positive judgment (YES) is obtained in step S13, the control flow goes to step S14 in which the controlling portion 100 causes the velocity controller 102 to control the second conveying mechanism 60 such that the recording sheet is conveyed at the first conveyance velocity. In this instance, since the trailing end portion of the recording sheet has already passed the first position 25 that is opposed to the first recording head 21, the change of the conveyance velocity does not affect the image recorded on the recording sheet. Further, since the recording sheet is being conveyed along the second conveying path without via the second position 26 that is opposed to the second recording heads 22, the image recorded on the recording sheet is not affected by the change of the conveyance velocity even if the conveyance velocity were changed. Thus, the recording sheet is conveyed at the first conveyance velocity in a pre-recording stage and a post-recording stage which are before and after the above-described second velocity stage (since the leading end portion of the recording sheet is detected by the sheet detection sensor 7 until the trailing end portion of the recording sheet is detected by the sheet detection sensor 9), respectively, so that a length of time required for conveying the recording sheet from the sheet supply unit 10 to the sheet exit portion 5 can be made smaller than in an arrangement where the recording sheet is conveyed at the second conveyance velocity in not only the second velocity stage but also the pre-recording stage and post-recording stage, namely, where the recording sheet is conveyed at the second conveyance velocity throughout the second conveying path.

Then, in step S15, the controlling portion 100 judges whether one-side recording is requested by the above-described command (inputted to the controlling portion 100 by the operator). Where one-side recording is requested by the command, namely, where a positive judgment (YES) is obtained in step S15, the control flow goes to step S16 in which the controlling portion 100 controls the second conveying mechanism 60 such that the recording sheet is conveyed toward the sheet exit portion 5. Where both-side recording is requested by the command, namely, where a negative judgment (NO) is obtained in step S15, the control flow goes to step S17 in which, when the trailing end portion of the recording sheet is detected by the sheet detection sensor 79, the controlling portion 100 controls the pair of conveying rollers 73 such that the conveying rollers 73 are rotated in reverse directions (that are opposite to forward directions in which the conveying rollers 73 have been rotated for conveying the recording sheet toward the sheet exit portion 5) whereby the recording sheet is conveyed back toward the pair of conveying rollers 16 by the reconveying mechanism 70.

In the present embodiment, under control by the controlling portion 100, the image is recorded onto the bottom face of the recording sheet in the same manner as when the image has been recorded on the top face of the recording sheet. Thus, the both-side monochrome recording onto the recording sheet is completed. As described above, where monochrome image is to be recorded on a recording sheet, the recording sheet is conveyed along the second conveying path via the first position 25 (that is opposed to the first recording head 21) and the third position 27 but without via the second position 26 (that is opposed to the second recording heads 22). Therefore, the recording sheet does not pass the second position 26 so that there is substantially no risk that foreign substances adhere onto the ejection surfaces 24 of the second recording heads 22 or onto other parts of the second recording heads 22 adjacent to the ejection surfaces 24. Further, since the ejection surfaces 24 of the second recording heads 22 are capped by the second cap 92 while the recording sheet is being conveyed along the second conveying path, foreign substances such as paper dust do not flutter around the ejection surfaces 24 of the second recording heads 22. Therefore, where color recording is not carried out, the second recording heads 22 do not require maintenance operations such as flushing and purging operations for ejecting ink through the ink ejection holes 23 for cleaning purpose, thereby making it possible to save an amount of ink that is be consumed in the maintenance operations.

Further, in the present embodiment, where monochrome image is to be recorded on a recording sheet, the recording sheet is conveyed to pass the third position 27 without passing the second position 22 (that is opposed to the second recording heads 22). Since the conveyance velocity of the recording sheet is reduced prior to collision of the recording sheet with the pivotable flapper 66 taking the first posture, it is possible to prevent the conveyance velocity of the recording sheet from being drastically reduced and accordingly to restrain disorder of the image recorded onto the recording sheet by the first recording head 21. In addition, since the ink ejection from the first recording head 21 is momentarily stopped when the conveyance of the recording sheet is momentarily stopped upon collision of the recording sheet with the flapper 66, it is possible to further reliably prevent disorder of the image recorded onto the recording sheet by the first recording head 21.

[Second Embodiment]

Figure 7:
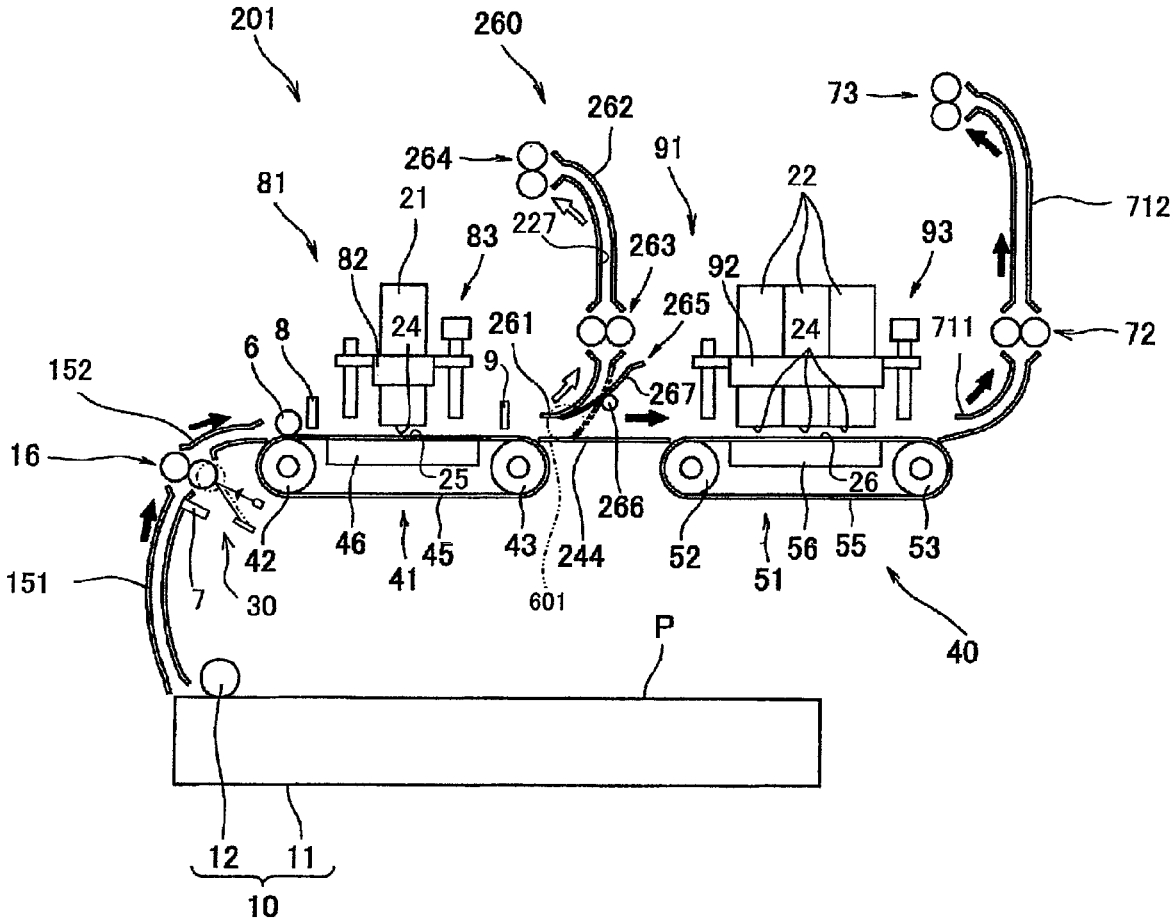
FIG. 7 is a side view schematically showing an internal construction of an inkjet printer 201 according to a second embodiment of the invention.

Referring next to FIG. 7, there will be described an inkjet printer 201, which is constructed according to a second embodiment of the invention.

In the inkjet printer 201, the reconveying mechanism 70 is not provided, and a second conveying mechanism 260 and a fork 265 are provided between the first recording head 21 and the set of second recording heads 22. In the following description of the second embodiment, the same reference signs as used in the description of the first embodiment are used to identify the same components or elements, which will not be described to avoid redundancy of the description. It is noted that the conveying guide 711 shown in FIG. 7 is denoted by the same reference sign 711 as used in the description of the first embodiment, since it is substantially the same as that in the first embodiment, except for shape of its part which is different from that in the first embodiment.

The second conveying mechanism 260 has conveying guides 261, 262 and two pairs of conveying rollers 263, 264, and defines the second conveying path that is indicated by thick arrow (white arrow) in FIG. 7. The conveying guides 261, 262 are curved, and extend upwardly from substantially a center of the straight path section. The second conveying path diverges from the straight path section that communicates the first and second positions 25, 26, so that the recording sheet conveyed along the second conveying path is caused to pass the third position 227, without passing the second position 26. The third position 227 is other than the second position 26, and is defined by the conveying guide 262 that constitutes a part of the second conveying mechanism 260. Each pair of the two pairs of conveying rollers 263, 264 consist of a drive roller that is to be rotated by a conveying motor (not shown) that is controlled by the controlling portion 100 and a driven roller that is to be rotated by rotation of the drive roller. The pair of conveying rollers 264 are disposed in substantially a center of the sheet exit portion 5 in the sub-scanning direction, so that the recording sheet which is discharged by the pair of conveying rollers 264 is received by the sheet exit portion 5.

In the fork 265, there are disposed a rotary shaft 266, a pivotable flapper 267 and a motor (not shown) that is to be controlled by the controlling portion 100 so as to rotate the rotary shaft 266. The flapper 267 is fixed to a side surface of the shaft 266, and cooperates with the conveying guide 261 to define a part of the second conveyance path therebetween. Between the first and second units 41, 51, a plate-like shaped conveying guide 244 is disposed in place of the conveying guide 44 that is employed in the inkjet printer 1 of the above-described first embodiment.

When a color image is to be recorded onto a recording sheet, the controlling portion 100 controls the sheet supply unit 10, three pairs of conveying rollers 16, 72, 73, first conveying mechanism 40 and first and second recording heads 21, 22, in substantially the same manner as in the above-described first embodiment, such that the color image is formed onto the recording sheet having been conveyed to the first conveying mechanism 40 from the sheet supply unit 10, and then the recording sheet is discharged toward the sheet exit portion 5, as indicated by thick arrow (black arrow) in FIG. 7. In this instance, the pivotable flapper 267 disposed in the fork 265 takes the second posture, so that the flapper 267 is in contact at its end portion with the conveying guide 261, and opens and closes the straight path section and the second conveying path, respectively.

On the other hand, when a monochrome image is to be recorded onto a recording sheet, the controlling portion 100 causes the rotary shaft 266 to be rotated whereby the pivotable flapper 267 is pivoted such that the flapper 267 takes the first posture. When taking the first posture, the flapper 267 is in contact at its end portion with the conveying guide 244, and closes and opens the straight path section and the second conveying path, respectively. The second conveying path includes the bent path section 601 that is defined by the flapper 267 taking the first posture. Then, the controlling portion 100 controls the sheet supply unit 10, the three pairs of conveying rollers 16, 263, 264, the first unit 41 of the first conveying mechanism 40 and the first recording head 21, such that the monochrome image is formed on the recording sheet having been conveyed from the sheet supply unit 10 to the first unit 41, and then the recoding sheet is conveyed via the third position 227 so as to be discharged toward the sheet exit portion 5. In the present second embodiment, too, the second recording heads 22 may be capped by the second cap 92 where a monochrome image is to be recorded onto a recording sheet.

In the inkjet printer 201 according to the second embodiment, too, where the recording sheet is conveyed via the third position 227 without via the second position 26 (that is opposed to the second recording heads 22), so as to be subjected to monochrome recording, the conveyance velocity of the recording sheet is reduced prior to collision of the recording sheet with the pivotable flapper 267 taking the first posture, so that it is possible to prevent the conveyance velocity of the recording sheet from being drastically reduced. Therefore, even if the ink ejection from the first recording head 21 were kept upon collision of the recording sheet with the flapper 267, it would be possible to restrain disorder of the image recorded onto the recording sheet by the first recording head 21. In addition, since the ink ejection from the first recording head 21 is momentarily stopped when the conveyance of the recording sheet is momentarily stopped upon collision of the recording sheet with the flapper 267, it is possible to further reliably prevent disorder of the image recorded onto the recording sheet by the first recording head 21.

[Modifications]

While the embodiments of the present invention have been described above in detail, it is to be understood that the invention is not limited to the details of the above-described embodiments, but may be otherwise embodied.

In the above-described embodiments, the first recording head 21 is assigned to monochrome recording and is configured to eject black ink while the second recording heads 22 are assigned to color recording and are configured to eject magenta, cyan and yellow inks. However, these are not essential. For example, the first recording head may be configured to eject color ink (non-black ink) while the second recording heads may be configured to eject black ink. Further, the first recording head may be configured to eject a pretreatment liquid for facilitating fixation of black ink onto a recording sheet while the second recording head may be configured to eject the black ink. Further, each of the first and second recording heads 21, 22 does not necessarily have to be configured to eject ink but may be configured to eject other liquid.

In the above-described embodiments, the first/second-positions communicating path section of the first conveyance path, which communicates the first position 25 and the second position 26, is the straight path section, while the first/third-positions communicating path section of the second conveyance path, which communicates the first position 25 and the third position 27, is the largely-bent path section 601. However, these are not essential. For example, the first/second-positions communicating path section of the first conveyance path may be a bent path section, wile the first/third-positions communicating path section of the second conveyance path may be a straight path section. Further, both of the first/second-positions communicating path section and the first/third-positions communicating path section may be bent path sections, as long as one of the first/second-positions communicating path section and the first/third-positions communicating path section is bent larger than the other of the first/second-positions communicating path section and the first/third-positions communicating path section.

In the above-described embodiments, the fork 65 or 265 is located between the first and second units 41, 51 or disposed between the first recording head 21 and the second recording heads 22. However, this is not essential. For example, the fork 65 or 265 may be located on an upstream side, as viewed in the conveyance direction C, of the first unit 41, as long as one of the first/second-positions communicating path section and the first/third-positions communicating path section is bent larger than the other of the first/second-positions communicating path section and the first/third-positions communicating path section.

In the above-described embodiments, the arrival time, which is to be memorized by the memory 101, is a length of time since the leading end portion of the recording sheet conveyed at the second conveyance velocity is detected by the sheet detection sensor 8 until the leading end portion of the recording sheet reaches the pivotable flapper 66 taking the first posture. However, this is not essential. For example, the arrival time may be a length of time since the leading end portion of the recording sheet conveyed at the second conveyance velocity is detected by the sheet detection sensor 7 (rather than by the sensor 8) until the leading end portion of the recording sheet reaches the flapper 66 taking the first posture. That is, the arrival time may be any other length of time, as long as the length of time is based on result of detection of a sheet detection sensor that is disposed on an upstream side, as viewed in the conveyance direction C, of the first recording head 21.

Further, the velocity controller 102 may be configured to control the conveyance velocity of the recording sheet such that conveyance velocity is equalized to the second conveyance velocity after the leading end portion of the recording sheet has been detected by the sheet detection sensor 8, namely, such that the conveyance velocity is kept at the first conveyance velocity until the leading end portion of the recording sheet is detected by the sheet detection sensor 8.

In the above-described embodiments, the controlling position 100 causes the ejection-stop time determiner 103 to determine the ejection stop time in step S6. However, the ejection stop time does not necessarily have be determined in step S6 but may be determined later, as long as the determination is made at latest before step S10.

In the above-described embodiments, the memory 101 stores therein the table representing the relationship between the conveyance-stop time and the thickness of the recording sheet. However, what is to be stored in the memory 101 may be either a graph representing the relationship between the conveyance-stop time and the thickness of the recording sheet or a table of the conveyance-stop time in which the conveyance velocity and the thickness of the recording sheet are represented in rows and columns of the table. Further, the ejection-stop time determiner 103 may be configured to determine the ejection-stop time, based on the thickness of the recording sheet.

Each of the inkjet printers 1, 201 does not necessarily have to have the above-described sheet thickness detector 30 and ejection-stop time determiner 103. Where the inkjet printer does not have the sheet thickness detector 30 and ejection-stop time determiner 103, the memory 101 may be configured to memorize a predetermined length of time as the ejection-stop time, and it is judged in step S11 whether the predetermined ejection-stop time memorized in the memory 101 has elapsed or not. The predetermined ejection-stop time, which is to be memorized in the memory 101 of each of the inkjet printers 1, 201, may be predetermined based on result of test recording, which is made, when each of the inkjet printers 1, 201 has been manufactured, by causing the first recording head 21 to record a test pattern image onto a recording sheet conveyed at the second conveyance velocity along the second conveying path. It is noted that the predetermined ejection-stop time, which is to be memorized in the memory 101 of each of the inkjet printers 1, 201, does not have to be necessarily predetermined based on test recording made for the same inkjet printer, but may be predetermined based on result of test recording made for the other inkjet printer or may be predetermined based on average of test recordings made for the other inkjet printers. Further, the predetermined ejection-stop time may be predetermined even without test recording.

Each of the inkjet printers 1, 201 does not necessarily have to have the above-described sheet thickness detector 30, ejection-stop time determiner 103 and ejection stop controller 104. Where the inkjet printer does not have the sheet thickness detector 30, ejection-stop time determiner 103 and ejection stop controller 104, the controlling portion 100 does not implement the above-described steps S5, S6, S9, S10, S11 and S12. That is, the first recording head 21 continues ejecting the ink without stopping ejecting the ink for the ejection stop time. In this arrangement without stop of the ink ejection from the first recording head 21, too, where the recording sheet is conveyed along the second conveying path, the recording sheet is conveyed at the second conveyance velocity in the second velocity stage since the leading end portion of the recording medium passes the sheet detection sensor 7 until the trailing end portion of the recording medium passes the sheet detection sensor 9, so that it is possible to restrain the conveyance velocity of the recording sheet from being momentarily drastically reduced upon collision of the leading end portion of the recording sheet with the pivotable flapper 66 or 267, and accordingly to restrain disorder of the image recorded by the first recording head 21 onto the recording sheet.

What is claimed is:

1. An image recording apparatus comprising:

first and second recording heads each having an ejection surface through which liquid is to be ejected onto a recording medium;

a first-conveyance-path definer defining a first conveyance path along which the recording medium is to be conveyed via a first position and a second position such that the recording medium is opposed to said ejection surface of said first recording head when the recording medium is being positioned in said first position and such that the recording medium is opposed to said ejection surface of said second recording head when the recording medium is being positioned in said second position;

a second-conveyance-path definer defining a second conveyance path along which the recording medium is to be conveyed via said first position and a third position and without via said second position, said third position being other than said second position; and a velocity controller configured to control a conveyance velocity at which the recording medium is to be conveyed along said first and second conveyance paths;

wherein said first conveyance path includes a first/second-positions communicating path section that is located between said first and second positions while said second conveyance path includes a first/third-positions communicating path section that is located between said first and third positions, such that one of said first/second-positions communicating path section and said first/third-positions communicating path section is bent larger than the other of said first/second-positions communicating path section and said first/third-positions communicating path section, wherein said velocity controller is configured to control the conveyance velocity of the recording medium such that the conveyance velocity is varied based on whether the recording medium is currently being conveyed along a path section that is bent larger than another path section, wherein said velocity controller is configured to control the conveyance velocity to a first velocity, while the recording medium is being conveyed along said other of said first/second-positions communicating path section and said first/third-positions communicating path section, with the liquid being ejected from said first recording head onto the recording medium, and wherein said velocity controller is configured to control the conveyance velocity to a second velocity that is lower than said first velocity, while the recording medium is being conveyed along said one of said first/second-positions communicating path section and said first/third-positions communicating path section, with the liquid being ejected from said first recording head onto the recording medium.

2. The image recording apparatus according to claim 1, further comprising:

a medium presence detector disposed in a medium-presence-detector position that is located on an upstream side of said first recording head in a conveyance direction in which the recording medium is to be conveyed, said medium presence detector being configured to detect presence of the recording medium in said medium-presence-detector position; and a route judger configured to judge whether the recording medium is to be conveyed along said one or said other of said first/second-positions communicating path section and said first/third-positions communicating path section, wherein said velocity controller is configured, when said route judger judges that the recording medium is to be conveyed along said one of said first/second-positions communicating path section and said first/third-positions communicating path section, to control the conveyance velocity to said second velocity, in response to detection of the recording medium by said medium presence detector.

3. The image recording apparatus according to claim 2, further comprising, in addition to said medium presence detector as a first medium presence detector disposed in said medium-presence-detector position as a first medium-presence-detector position, a second medium presence detector which is disposed in a second medium-presence-detector position that is located on a downstream side of said first recording head in the conveyance direction and on an upstream side of said one of said first/second-positions communicating path section and said first/third-positions communicating path section in the conveyance direction, said second medium presence detector being configured to detect presence of the recording medium in said second medium-presence-detector position, wherein said velocity controller is configured to control the conveyance velocity to said second velocity in a second velocity stage since a leading end portion of the recording medium passes said first medium-presence-detector position until a trailing end portion of the recording medium passes said second medium-presence-detector position.

4. The image recording apparatus according to claim 3, wherein said velocity controller is configured to control the conveyance velocity to said first velocity in at least one of a pre-recording stage and a post-recording stage which are before and after said second velocity stage since the leading end portion of the recording medium passes said first medium-presence-detector position until the trailing end portion of the recording medium passes said second medium-presence-detector position, respectively.

5. The image recording apparatus according to claim 1, further comprising an ejection stop controller configured to stop ejection of the liquid from said first recording head, wherein said ejection stop controller is configured, upon arrival of a leading end portion of the recording medium in a bent portion included in said one of said first/second-positions communicating path section and said first/third-positions communicating path section, to stop ejection of the liquid from said first recording head for a given length of time, and to restart ejection of the liquid from said first recording head after the given length of time.

6. The image recording apparatus according to claim 5, further comprising a pivotable flapper disposed in a fork in which said first and second conveyance paths diverge from each other, said pivotable flapper being pivotable so as to selectively take first and second postures, wherein said pivotable flapper is configured, when taking said first posture, to close said other of said first/second-positions communicating path section and said first/third-positions communicating path section and to guide the recording medium to be conveyed along said one of said first/second-positions communicating path section and said first/third-positions communicating path section, wherein said pivotable flapper is configured, when taking said second posture, to open said other of said first/second-positions communicating path section and said first/third-positions communicating path section and to guide the recording medium to be conveyed along said other of said first/second-positions communicating path section and said first/third-positions communicating path section, and wherein said bent portion included in said one of said first/second-positions communicating path section and said first/third-positions communicating path section is defined by said pivotable flapper when said pivotable flapper takes said first posture.

7. The image recording apparatus according to claim 5, further comprising:

a medium presence detector disposed in a medium-presence-detector position that is located on an upstream side of said first recording head in a conveyance direction in which the recording medium is to be conveyed, said medium presence detector being configured to detect presence of the recording medium in said medium-presence-detector position; and a memory configured to memorize a length of time from detection of the recording medium by said medium presence detector until arrival of the leading end portion of the recording medium in said bent portion included in said one of said first/second-positions communicating path section and said first/third-positions communicating path section, wherein said ejection stop controller is configured, when the stored length of time has passed from the detection of the recording medium by said medium presence detector, to stop the ejection of the liquid from said first recording head for the given length of time, and to restart ejection of the liquid from said first recording head after the given length of time.

8. The image recording apparatus according to claim 7, further comprising:

a medium thickness detector disposed on the upstream side of said first recording head in the conveyance direction, and configured to detect thickness of the recording medium; and an ejection-stop time determiner configured to determine, based on the thickness of the recording medium detected by said medium thickness detector, the given length of time for which the ejection of the liquid from said first recording head is to be stopped.

9. The image recording apparatus according to claim 1, further comprising a conveyor device that is configured to convey the recording medium along said first and second conveyance paths, wherein said velocity controller is configured to control actuation of said conveyor device, so as to control the conveyance velocity at which the recording medium is to be conveyed along said first and second conveyance paths.

* * * * *